US008733445B2

(12) United States Patent
Huang

(10) Patent No.: US 8,733,445 B2
(45) Date of Patent: May 27, 2014

(54) DISPOSABLE DOWNHOLE TOOL

(71) Applicant: Tianping Huang, Spring, TX (US)

(72) Inventor: Tianping Huang, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/892,390

(22) Filed: May 13, 2013

(65) Prior Publication Data

US 2013/0248194 A1 Sep. 26, 2013

Related U.S. Application Data

(63) Continuation of application No. 12/786,096, filed on May 24, 2010.

(51) Int. Cl.
*E21B 21/10* (2006.01)

(52) U.S. Cl.
USPC ..... 166/332.4; 166/318

(58) Field of Classification Search
USPC ..... 166/317, 318, 332.4
See application file for complete search history.

(56) References Cited

U.S. PATENT DOCUMENTS

| | | | | |
|---|---|---|---|---|
| 6,722,439 | B2 | 4/2004 | Garay et al. | |
| 6,805,198 | B2 | 10/2004 | Huang et al. | |
| 7,243,728 | B2 | 7/2007 | Stoesz et al. | |
| 8,127,856 | B1 | 3/2012 | Nish et al. | |
| 2009/0056934 | A1 | 3/2009 | Xu | |
| 2009/0065216 | A1 | 3/2009 | Frazier | |
| 2009/0159274 | A1 | 6/2009 | Frazier | |
| 2011/0147014 | A1 * | 6/2011 | Chen et al. | 166/387 |
| 2011/0155391 | A1 | 6/2011 | Scarsdale et al. | |
| 2011/0196125 | A1 | 8/2011 | Wann | |
| 2011/0214881 | A1 | 9/2011 | Newton et al. | |

OTHER PUBLICATIONS

Huang, Tianping et al., "Carbonate Matrix Acidizing Fluids at High Temperatures: Acetic Acid, Chelating Agents or Long-Chained Carboxylic Acids?"; Society of Petroleum Engineers, Paper No. 82268, 2002.

Weinberger, Ram et al., "Tensile properties of rocks in four-point beam tests under confining pressure," Rock Mechanics, Nelson & Laubach; 1994, pp. 435-442, Rotterdam.

* cited by examiner

*Primary Examiner* — Nicole Coy
(74) *Attorney, Agent, or Firm* — Cantor Colburn LLP

(57) ABSTRACT

A disposable downhole tool is disclosed. The tool is suitable for use as a frac tool. The tool includes a housing having an inner wall surface defining a bore. The tool also includes a valve structure disposed within the bore, the valve structure comprising a disposable plug seat, the disposable plug seat comprising a first natural rock material. The disposable tool may also include a disposable plug in fluid sealing engagement with the seat, the plug comprising a second natural rock material, the plug and the plug seat comprising a plug valve. The first and second natural rock materials may include sedimentary rock, such as various forms of limestone, including Carrara marble or Indiana limestone.

30 Claims, 2 Drawing Sheets

DISPOSABLE DOWNHOLE TOOL

CROSS-REFERENCE TO RELATED APPLICATIONS

This patent application claims priority to U.S. patent application Ser. No. 12/786,096 filed May 24, 2010, which is incorporated herein by reference in its entirety.

BACKGROUND

In the well completion and production arts, production systems that enable operators to pinpoint fluid placement and volume during openhole fracturing (frac) operations are very desirable. These systems are used to establish openhole isolation between zones, zone lobes, or fault lines, so fracture fluid may be delivered where it is needed, for maximum effect. The systems are designed to incorporate short-radius open-hole packers and frac sleeves to isolate intervals of an underground fluid production section for targeted fracturing treatment placement. The result is greater control of the frac treatment and a greater chance of fracturing the entire length of the lateral and increasing production.

Such systems may be advantageously deployed as a one-trip installation and set in place by the application of hydraulic pressure. Isolation and casing packers may be set against a ball seat in the shoe of the liner. The drill rig can then be moved to another location and the desired frac treatment may be performed by the application of hydraulic pressure by pumping when ready.

Frac treatment is performed by providing fluidic access through openings in the tubular string in a generally radial direction. Such openings allow fluid communication between the ID of the flow channel and an annulus created between the tubular string and a borehole wall (casing or openhole). Openable and closable valves are employed in concert with such openings to selectively promote and prevent the fluid movement noted above.

One frac sleeve arrangement employed in these systems is a slidable frac sleeve. A slidable frac sleeve employs a housing having an opening, a slidable sleeve translatable relative to the housing to either misalign entirely with the opening or to align a port with the opening, and a spring to bias the sleeve to a selected position (open or closed). The sleeve employs a plug valve that is configured to receive a plug to close the valve; the plug valve may include a ball seat in the sleeve that is configured to receive a corresponding ball that is configured to be seated in the ball seat for closing the valve. The systems typically employ a plurality of plug valves that are sized with successively smaller valve openings proceeding inwardly from the surface along the length of the production string.

In use, successively larger plugs (e.g. balls) are dropped into the string, each configured to engage a corresponding valve seat, closing their respective valves and opening the corresponding frac sleeves at various locations along the production string. Desired fracture volumes can be displaced with timing of the ball releases to accurately place frac fluid in each desired interval of the production string.

It has previously been the practice to remove the balls and ball seats in the sleeves after the frac operations. This has included flowing the balls back to the surface by high production rate flows and by drilling out the ball seats to recover a full-open string inside or inner diameter (ID). While effective, such ball removal and drilling operations represent additional drill string operations that require additional equipment and time on the drill rig.

Therefore, it is desirable to provide frac tools that incorporate plug valves, such as ball valves, that may be removed to recover the full ID of the drill string without drilling.

BRIEF DESCRIPTION

In an exemplary embodiment, a disposable downhole tool is disclosed that includes a housing having an inner wall surface defining a bore. The disposable downhole tool also includes a valve structure disposed within the bore, the valve structure comprising a disposable plug seat, the disposable plug seat comprising a natural rock material.

In another exemplary embodiment, a disposable downhole tool is disclosed that includes a disposable plug that is seatable against a disposable plug seat of a disposable valve structure, the disposable plug comprising a natural rock material.

BRIEF DESCRIPTION OF THE DRAWINGS

Referring now to the drawings wherein like elements are numbered alike in the several Figures.

DETAILED DESCRIPTION

Figure 1:
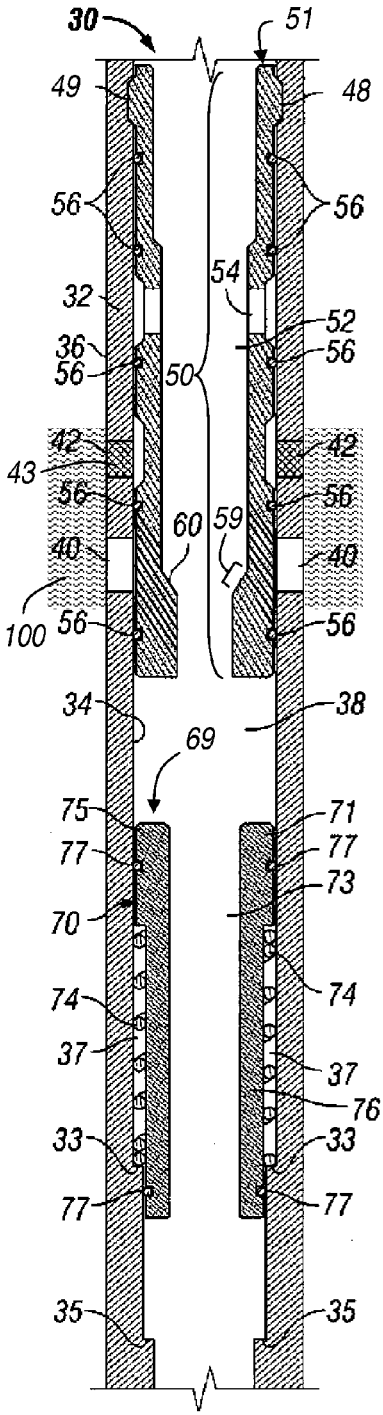
FIG. 1 is a cross-sectional view of an exemplary embodiment of a frac tool, including a disposable valve structure and sleeve, in a first position, as disclosed herein.
Figure 2:
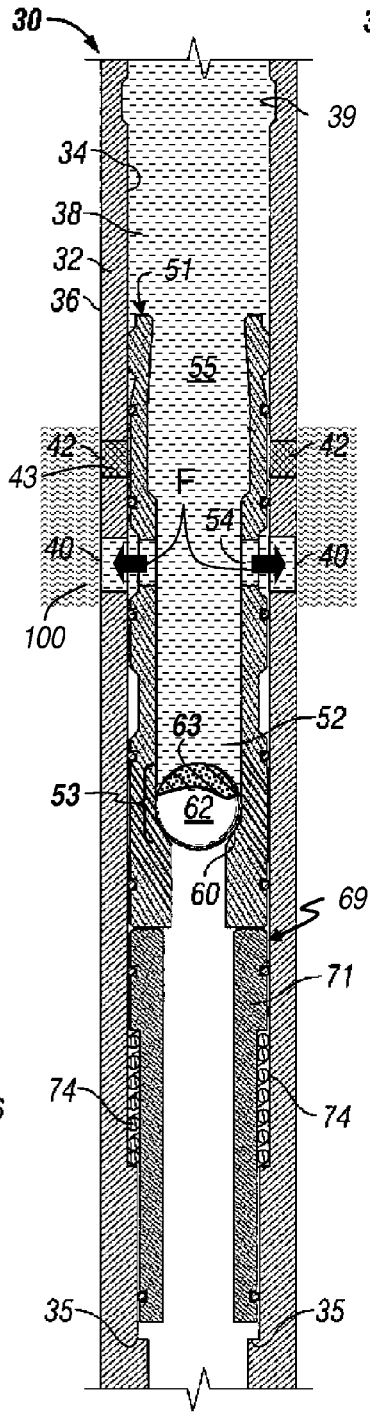
FIG. 2 is view of the frac tool of FIG. 1, together with a partial cross-sectional view of an exemplary embodiment of a disposable plug, forming an exemplary embodiment of a disposable plug valve, in a second position.
Figure 3:
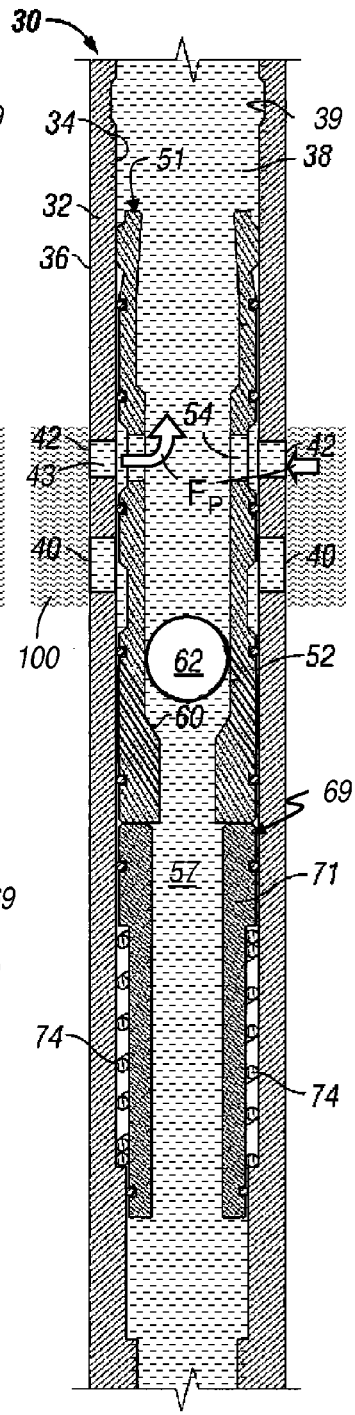
FIG. 3 is a view of the frac tool of FIG. 2 in a third position.

Referring to FIGS. 1-4, an exemplary embodiment of a downhole frac tool 30 is disclosed. The frac tool 30 includes an outer housing 32 that includes an inner wall surface 34 defining a bore 38. Frac tool 30 also includes a valve structure 50 disposed within the bore 38. The valve structure 50 is used to provide a disposable valve 53 that is configured to selectively control the flow (F) of a frac fluid 55 within frac tool 30 as shown in FIG. 2, particularly to selectively direct flow F of frac fluid 55 from the frac tool 30 into a surrounding earth formation in conjunction with frac operations. Valve structure 50 includes a disposable plug seat 59 for seating a disposable plug 62 in sealing engagement with therewith. Disposable plug seat 59 may include all manner of suitable disposable plug seats 59 for seating various forms disposable plugs 62, such as disposable balls 63, to form various disposable plug valves 53. In one exemplary embodiment, disposable plug seat 59 may include a disposable ball seat 60, such as a frustoconical ball seat 60, as illustrated in FIGS. 1-3. While illustrated herein as having a frustoconical form comprising a flat, planar, inwardly-tapering ball seat 60, disposable plug seat 59 may have any suitable plug seat form, including various curved, planar, inwardly-tapering surface forms (not shown). Disposable plug seat 59 and disposable plug 62 together may be used as a disposable plug valve 53.

Disposable valve structure 50, including disposable plug seat 59, includes a first natural material 61 that is dissolvable in a suitable dissolution fluid 80 as described herein, which may include naturally occurring downhole fluids, or a fluid introduced into the downhole environment in conjunction with frac or other drill string operations, or various acid fluid treatments introduced into the drill string, as described herein. Valve structure 50 and disposable plug seat 59 may be made either partially or completely of first natural material 61. First natural material 61 may include any suitable natural material, including any suitable form thereof. In an exemplary embodiment, first natural material 61 may include a sedimentary rock, including various forms of limestone. More particularly, the limestone may include calcite, and may also be formed predominantly from calcite. This includes the use of a first natural material 61 that includes, by weight, greater than 70 percent calcite. For example, first natural material 61 may include forms of limestone such as Carrara marble that is readily available in Europe or Indiana limestone that is readily available in the US. First natural material 61 may have an acid solubility greater than 70% and permeability of less than 10 millidarcy (mD). For example, Indiana limestone has a solubility of about 99.01% in 15% by volume hydrochloric acid and 98.86 in 10% by volume of dibasic acid, and a dissolution rate on the order of 0.5 grams per square centimeter per minute at ambient temperature. It also has a permeability of less than 3 mD. Indiana limestone is generally composed of greater than 98% calcite, which has high acid solubility. Additionally, the compressive Young's modulus of Indiana limestone is approximately 30,600 MPa with no dependence on confining pressure, which is comparable to that of high strength concrete. Limestone with similar properties is also readily available in other countries and on other continents.

The permeability of first natural material 61, as well as the other natural materials described herein, may also be reduced by filling the limestone matrix with another acid-soluble substance, such as a nanoparticle slurry, as a sealer. For example, as an option, a nanoparticle slurry may be used to fill in the limestone matrix to make the sealing surfaces, such as the surfaces of plug seat 59 and disposable plug 62, less permeable, thereby enhancing the seal formed between them. The nanoparticles may have relatively large surface charges per volume, thereby permitting the crystal particles to bond, associate, link, connect, group, or otherwise relate together to further reduce the permeability of the matrix of the natural materials to which they are applied. Exemplary acid-soluble nanoparticle slurries include, in non-limiting embodiments, ConFINE™, available from Baker Hughes, or a high-concentration slurry of approximately 35 nm magnesium oxide (MgO) particles in an appropriate fluid base, such as a diluent or solvent as described herein.

Disposable plug 62, including disposable ball 63, includes a second natural material 65 that is dissolvable in a suitable dissolution fluid 80 as described herein, which may include a naturally occurring downhole fluid, or a fluid introduced into the downhole environment in conjunction with frac or other drill string operations, or a predetermined dissolution fluid, including various acid treatments that may be introduced into the drill string as described herein. Disposable plug 62, including disposable ball 63, may be made either partially or completely of a second natural material 65. Second natural material 65 may include the same materials identified for use as first natural material 61. Second natural material 65 may be selected to be the same as first natural material 61, or may be selected to be a different natural material. Second natural material 65 may be selected so that it has the same dissolution rate in a given dissolution fluid 80 as first natural material 61, or may be selected to have a different dissolution rate. The selection of different first natural material 61 and second natural material 65 enables predetermined and selective dissolution of, for example, disposable plug 62 prior to disposable valve structure 50, or vice versa.

Valve structure 50 and valve 53 may be used in various frac tools 30, including various forms of slidable disposable sleeves 51. Frac tools, including slidable disposable sleeves 51 may also include or work in conjunction with other disposable components 69, such as disposable return member 70, including disposable return sleeve 71. Disposable components 69, such as disposable return member 70, including disposable return sleeve 71, includes a third natural material 67 that is dissolvable in a suitable dissolution fluid 80 as described herein, including naturally occurring downhole fluids or a fluid introduced into the downhole environment in conjunction with frac or other drill string operations, or dissolution fluid, including various acid treatments introduced into the drill string, as described herein. Disposable components 69, such as disposable return member 70, including disposable return sleeve 71, may be made either partially or completely of third natural material 67. Third natural material 67 may include the same materials identified for use as first natural material 61 or second natural material 65. Third natural material 67 may be selected to be the same as first natural material 61 or second natural material 65, or any combination thereof, or may be selected to be a different material than first natural material 61 or second natural material 65, or any combination thereof, or any combination of the same or different materials. Third natural material 67 may be selected so that it has the same dissolution rate in a given dissolution fluid 80 as first natural material 61 or second natural material 65, or these materials may be selected to have a different dissolution rate. The selection of different first natural material 61, second natural material 65 or third natural material 67 enable predetermined and selective dissolution of, for example, disposable component 69 prior to disposable plug 62 or disposable valve structure 50, in any combination.

Referring now to FIGS. 1-3, frac tool 30 includes outer housing 32 having inner wall surface 34, outer wall surface 36, bore 38, first or frac port, 40, and second or production port 42. First or frac port 40 may also include a first fluid flow control member or device shown as a screen 41 that allows frac fluid 55 to flow out into earth formation 100 through first port 40, but prevents certain sized particulate matter from flowing back into housing 32 and bore 38 from earth formation 100 through first port 40. Second port 42 may include a second fluid flow control member or device shown as screen 43 that allows liquids to flow through second port 42, but prevents certain sized particulate matter from flowing through second port 42. Either of first port 40 or second port 42 may also include a fluid flow control member such as a choke (not shown), that is capable of controlling the pressure drop and flow rate through the port.

Disposable sleeve 51 is in slidable engagement with inner wall surface 34. Disposable sleeve 51 includes bore 52 and retaining member 48 shown as a flange 49 that is disposed within recess 39 in inner wall surface 34. Disposable sleeve 51 also includes sleeve port 54 and an actuator for moving disposable sleeve 51 from the desired run-in position (FIG. 1) to the first operational position (FIG. 2) where frac fluid 55 and plug 62 are introduced to frac tool 30 and disposable sleeve 51. The actuator may be any device or method known to persons of ordinary skill in the art, including action of pressurized frac fluid 55 against disposable plug 62 to seat plug 62 against disposable plug seat 59. As shown in FIGS. 1-3, the actuator is a disposable plug seat 59 such as disposable ball seat 60 capable of receiving disposable plug 62 such as disposable ball 63. Although FIGS. 1-3 show disposable ball seat 60 and disposable ball 63, it is to be understood that the disposable plug seat 59 is not required to be a disposable ball seat 60 and the disposable plug 62 is not required to a disposable ball 63. Instead, the disposable plug seat 59 can have any other shape desired or necessary for receiving a reciprocally or complementary shaped disposable plug 62. Disposable sleeve 51 may include dynamic seals 56 (numbered only in FIG. 1) to assist sleeve 51 in sliding along inner wall surface 34 and to reduce the likelihood of leaks between inner wall surface 34 and the outer wall surface of sleeve 51.

Also disposed along inner wall surface 34 is disposable return member 70. Disposable return member 70 comprises a disposable return sleeve 71 having bore 73 and disposable bias member 74. Although disposable bias member 74 is shown as an elastic member such as a spring in FIGS. 1-3, it is to be understood that disposable bias member 74 can be another elastic device that is capable of being biased to exert a force upward against sleeve 51 when sleeve 51 is in the first operational position (FIG. 2). Suitable elastic members for utilization as biased member 74 include Belleville springs (also known as Belleville washers), capillary springs, and deformable elastomers and polymers. Disposable bias member 74 may be rendered disposable by appropriate selection of the material of bias member 74 and dissolution fluid 80 so that member has a high solubility in the fluid. Return sleeve 71 is in slidable engagement with inner wall surface 34. As shown in FIGS. 1-3, inner wall surface 34 includes shoulders 33 and 35 and return sleeve 71 comprises a head portion 75 and a stem portion 76. Dynamic seals 77 (numbered only in FIG. 1) disposed on return sleeve 71 assist return sleeve 71 in sliding along inner wall surface 34 and to reduce the likelihood of leaks between inner wall surface 34 and the outer wall surface of return sleeve 71. Head portion 75 and shoulder 33 form chamber 37 in which biased member 74 is disposed. Shoulder 35 provides a stop to prevent sliding of return sleeve 71 at a predetermined location along inner wall surface 34. Biased member 74 is disposed within chamber 37 and on shoulder 33 so that biased member 74 can urge head portion 75 and, thus, return sleeve 71 upward.

The operation of frac tool 30 is now described with reference to FIGS. 1-4. As illustrated in FIG. 2, frac fluid 55 and disposable ball 63 are introduced to bore 38. Disposable ball 63 engages disposable ball seat 60 to restrict fluid flow through bore 52. Fluid pressure, such as may be developed by pumping frac fluid 55 down through bore 38, is exerted onto disposable ball 63 causing retaining member 53 to release from inner wall surface 34 so that disposable sleeve 51 is forced downward into disposable return member 70. Disposable sleeve 51 continues to be forced downward, energizing biased member 74, until disposable return sleeve 71 engages stop shoulder 35. In this position, sleeve port 54 is aligned with first port 40 of housing 32 and, thus, frac tool 30 is in the first operational position as shown in FIG. 2. Accordingly, pressurized frac fluid 55 can be pumped from bore 38, through sleeve port 54, through first port 40, and into the well or well formation to fracture the formation.

As shown in FIG. 3, after sufficient frac fluid 55 is injected into the well or openhole formation, it may be desirable to assess production by moving disposable sleeve 51 to a second operational position, as illustrated in FIG. 3, where production inflow $F_P$ through second port 42, or ports 42, from the surrounding earth formation 100 may be assessed. Ball 63 is removed from ball seat 60 through any method known to persons skilled in the art. For example, disposable ball 63 may be removed from ball seat 60 by increasing the fluid pressure of the frac fluid 55 being pumped downward through bore 38 until disposable ball 63 is forced through ball seat 60 so that it can fall to the bottom of the well. Alternatively, disposable ball 63 may be removed from ball seat 60 by decreasing the fluid pressure of the fracturing fluid being pumped downward through bore 38 so that ball 63 can float back to the surface of the well. Still alternately, ball 63 may be selected so that it may be preferentially dissolved either completely or partially sufficiently to pass through ball seat 60 and fall to a location lower in the well, including to the bottom of the well.

Reduction of the fluid pressure of the frac fluid 55 in conjunction with removal of ball 63 allows energized biased member 74 to overcome the downward force of the frac fluid 55. When the upward force of biased member 74 overcomes the downward force of the frac fluid 55, disposable return member 70 begins to move upward and, thus, forces disposable sleeve 51 upward from the first operational position (FIG. 2) to the second operational position (FIG. 3). In this position, sleeve port 54 is aligned with second port 42 of housing 32 and, thus, frac tool 30 is in the second operational position as shown in FIG. 3 where production flow $F_P$ into housing 32 and bore 38 through second port 42 is possible. Accordingly, return fluids 57, such as oil, gas, and water, are permitted to flow from the well or well formation and into bore 38 so that the return fluids 57 can be collected at the surface of the well.

Movement of frac tool 30 from the first operational position (FIG. 2) to the second operational position (FIG. 3) did not require any well intervention using another tool or device. All that was required was the reduction of fluid pressure forcing disposable sleeve 51 into disposable return member 70 either to facilitate both removal of the restriction in bore 52 and movement of disposable sleeve 51 from the first operational position (FIG. 2) to the second operational position (FIG. 3), or to facilitate movement of disposable sleeve 51 from the first operational position (FIG. 2) to the second operational position (FIG. 3) after the restriction in bore 52 has been removed by other non-intervention means, e.g., forcing disposable ball 63 through ball seat 60, allowing it to float to the surface or dissolving it by introduction of an appropriate dissolution fluid 80. In an additional embodiment, bore 52 can remain restricted during production operations, i.e., when frac tool 30 is in the second operational position.

In the embodiments discussed herein with respect FIGS. 1-3, upward, toward the surface of the well (not shown), is toward the top of FIGS. 1-3, and downward or downhole (the direction going away from the surface of the well) is toward the bottom of FIGS. 1-3. In other words, "upward" and "downward" are used with respect to FIGS. 1-3 as describing the vertical orientation illustrated in FIGS. 1-3. However, it is to be understood that frac tool 30 may be disposed within a horizontal or other deviated well so that "upward" and "downward" are not necessarily oriented vertically.

Figure 4:
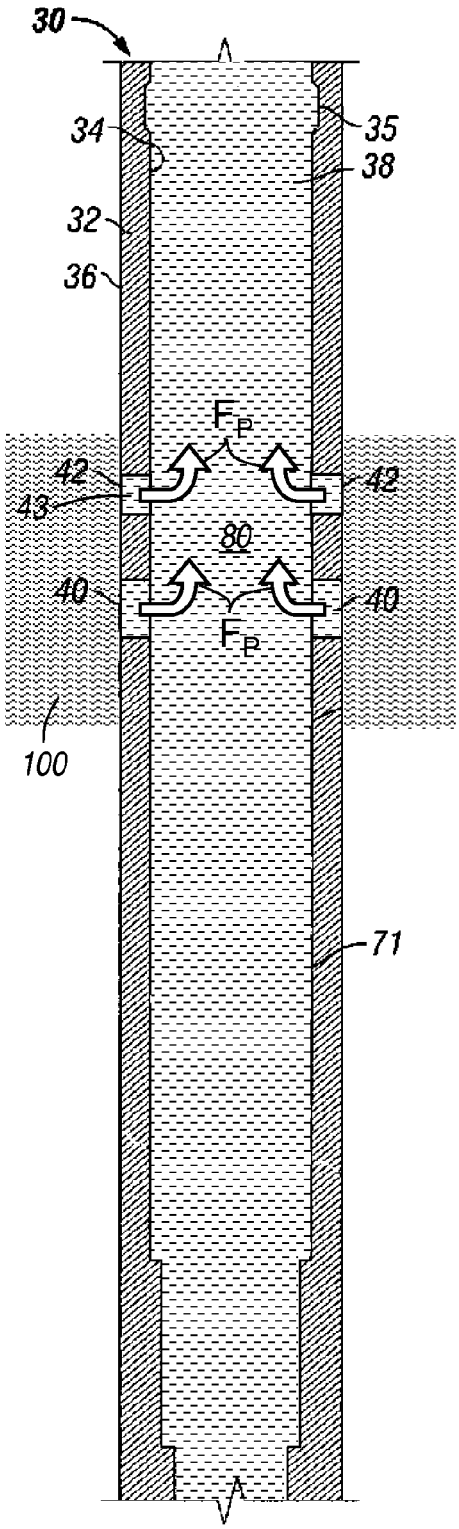
FIG. 4 is a view of the frac tool of FIG. 2 in a fourth position.

As shown in FIG. 4, after injection of frac fluid 55 into the well or openhole formation and assessment of return fluid 57 production has indicated a desired flow $F_P$, and there is no longer a need to use frac tool 30, particularly disposable plug valve 53, portions of the tool, including disposable valve structure 50, disposable plug 62 and other disposable components, such as disposable return member 70, may be disposed of to recover the full diameter of housing 32 and bore 38, thereby removing the restrictions therein associated with these portions of frac tool 30 and a fourth position of the tool. The disposable portions of frac tool 30 may be removed from housing 32 by dissolution using a predetermined dissolution fluid 80. Dissolution fluid 80 may be any fluid suitable for use as a downhole fluid that is configured to dissolve first natural material 61, second natural material 65 or third natural material 67, or any combination thereof that is desired. In an exemplary embodiment, dissolution fluid 80 may include an acid fluid, including an inorganic acid, organic acid or a combination thereof. As used herein, an acid fluid may include various liquid inorganic or organic acids, or combinations thereof, and may also include an acid precursor, or combination of precursors, in any material state or form that may be used to form an acidic dissolution fluid 80, including various anhydrous or other materials that may be hydrolyzed to form a desired acid fluid as dissolution fluid 80.

In one example, an inorganic acid dissolution fluid 80 may include hydrochloric acid (HCl) or a hydrochloric acid mixture, including a mixture of hydrofluoric acid and hydrochloric acid. This includes conventional wellbore inorganic acidizing fluids that include hydrochloric acid, including those having a high acid strength. Further exemplary inorganic acid fluids which may be used include, but are not limited to, sulfuric, hydrofluoric, fluoroboric or phosphoric acid, or a combination of the above inorganic acids.

In another example, an organic acid dissolution fluid 80 may include an organic acid fluid system and method for matrix acidization of subterranean formations penetrated by a wellbore, including acidization at temperatures in excess of about 200° F. (92° C.). One suitable organic acid fluid contains at least one water-soluble dicarboxylic acid. In one non-limiting embodiment of an organic acid fluid, the dicarboxylic acid is of relatively low molecular weight, that is, has a formula weight of 175 or less. Suitable dicarboxylic acids therefore include, but are not necessarily limited to, oxalic (ethanedioic), malonic (propanedioic), succinic (butanedioic), glutaric (pentanedioic), adipic acid (hexanedioic), or pimelic (heptanedioic) acid, or combinations thereof, including mixtures thereof. In another embodiment, the dicarboxylic acids are selected from the group consisting of succinic, glutaric and adipic acid, and mixtures thereof. In a non-limiting embodiment, the organic acid fluid may include a dibasic acid comprising 51-61 weight percent glutaric acid, 18-28 weight percent succinic acid, and 15-25 weight percent adipic acid. Interestingly, glutaric, succinic and adipic acid have been used as components for corrosion inhibitors for ferrous metals. Further exemplary inorganic acids which may be used include, but are not limited to, formic, acetic, citric, sulfonic, glycolic acid, or combinations of the above organic acids. Dissolution fluid 80 also include other suitable acid fluids, including various acidic chelating agents, such as, for example, ethylenediaminetetraacetic acid (EDTA), disodium EDTA ($Na_2EDTA$), hydroxyethylethylenediaminetriacetic acid (HEDTA), docosatetraenoic acid (DTA), nitrilotriacetic acid (NTA), hydroxyaminopolycarboxylic acid (HACA), diethylenetriaminepentaacetic acid (DTPA), hydroxyethyliminodiacetic acid (HEIDA), or polyaspartic acid (PASP) and the like, or combinations thereof.

In addition to dissolution of the disposable elements of frac tool 30 described herein, the organic acid fluid systems of the invention can also effectively generate wormholes to stimulate production in subterranean carbonate formations and dissolve carbonate scale, and these organic acids mixed with hydrofluoric acid can effectively remove fines to recover production in sandstone formations at elevated temperatures. These organic acid fluids have very low corrosion on the tubing, casing and downhole equipment.

Based on the properties of glutaric, succinic and adipic acid, this composition of dicarboxylic acids and other combinations of dicarboxylic acids (or dicarboxylic acids used alone) can be used as acid compositions to stimulate high temperature wells in addition to dissolution of frac tool 30. This organic acid system, which is advantageously highly biodegradable, can also successfully remove the calcium carbonate scale and fines to stimulate production. Core flood testing demonstrates that this organic acid system can effectively remove calcium carbonate scales and fines at temperatures up to 400° F. (204° C.). In addition to its reactivity, the acid system, when combined with corrosion inhibitor, exhibits very low corrosion at high temperatures. These acid fluid systems may be used for successive removal of plugging fines from screens, such as screens 43 in addition to dissolution of the disposable elements of frac tool 30.

In some non-limiting embodiments, hydrofluoric acid may be used together with the dicarboxylic acids. Hydrofluoric acid may be used to aid in dissolving silicates. Alternatively, a substance that hydrolyzes to hydrofluoric acid may be used. Suitable substances include, but are not necessarily limited to, ammonium bifluoride and ammonium fluoride, alkali metal fluorides and bifluorides (where the alkali metal is typically sodium, potassium or the like) as well as transition metal fluorides (for instance hexafluorotitanate salts and the like) and mixtures thereof.

Suitable solvents or diluents for the acids described include, but are not necessarily limited to, water, methanol, isopropyl alcohol, alcohol ethers or aromatic solvents, or combinations thereof, including mixtures thereof. In one exemplary embodiment, the composition has an absence of monocarboxylic acids and/or an absence of tricarboxylic acids. Alternatively, in another exemplary embodiment, the acid composition has an absence of quaternary ammonium compounds and/or an absence of sulfur-containing corrosion inhibitor activator (e.g. thioglycolic acid, alkali metal sulfonate, etc.).

While one or more embodiments have been shown and described, modifications and substitutions may be made thereto without departing from the spirit and scope of the invention. Accordingly, it is to be understood that the present invention has been described by way of illustrations and not limitation.

What is claimed is:

1. A disposable downhole tool, comprising:

a housing having an inner wall surface defining a bore; and a valve structure for disposition within a bore of a housing, the valve structure comprising a disposable plug seat, the disposable plug seat having a sealing surface configured for sealing engagement with a plug to seal the bore, the sealing surface formed as a single rock piece of a fist natural rock material.

2. The disposable tool of claim 1 further comprising the plug, the plug comprising a disposable plug that comprises a second natural rock material, the plug and the plug seat comprising a plug valve.

3. The disposable tool of claim 2, wherein the plug seat comprises a ball seat and the plug comprises a ball.

4. The disposable tool of claim 2, wherein one of the first natural rock material or the second natural rock material comprises a sedimentary rock.

5. The disposable tool of claim 4, wherein the sedimentary rock comprises limestone.

6. The disposable tool of claim 5, wherein the limestone comprises calcite.

7. The disposable tool of claim 6, wherein the first natural rock material comprises, by weight, at least 70 percent calcite.

8. The disposable tool of claim 4, wherein the sedimentary rock comprises Carrara marble or Indiana limestone.

9. The disposable tool of claim 4, wherein a surface of the first natural rock material or a surface of the second natural rock material is treated with a sealer.

10. The disposable tool of claim 9, wherein the sealer comprises a slurry comprising nanoparticles.

11. The disposable tool of claim 2, wherein the first natural rock material and the second natural rock material each have a solubility greater than 70% in a dissolution fluid.

12. The disposable tool of claim 11, wherein the dissolution fluid comprises an organic or inorganic acid.

13. The disposable tool of claim 12, wherein the acid comprises a dicarboxylic acid.

14. The disposable tool of claim 13, wherein the acid comprises dicarboxylic acid comprises oxalic acid, malonic acid, succinic acid, glutaric acid, adipic acid, pimelic acid, or a combination thereof.

15. The disposable tool of claim 12, wherein the acid comprises hydrochloric acid, sulfuric acid, hydrofluoric acid, formic acid, acetic acid, fluoroboric acid, phosphoric acid, citric acid, sulfonic acid, glycolic acid, ethylenediaminetetraacetic acid (EDTA), disodium EDTA, hydroxyethylethylenediaminetriacetic acid, docosatetraenoic acid, nitrilotriacetic acid, hydroxyaminocarboxylic acid, diethylenetriaminepentaacetic acid, hydroxyethyliminodiacetic acid, polyaspartic acid, or a combination thereof.

16. The disposable tool of claim 2, wherein at least one of the first natural rock material of the disposable plug seat or the second natural material of the disposable plug comprises a single rock piece.

17. The disposable tool of claim 1, wherein the first natural rock material comprises a sedimentary rock.

18. The disposable tool of claim 17, wherein the sedimentary rock comprises limestone.

19. The disposable tool of claim 18, wherein the limestone comprises calcite.

20. The disposable tool of claim 19, wherein the first natural rock material comprises, by weight, at least 70 percent calcite.

21. The disposable tool of claim 17, wherein the sedimentary rock comprises Carrara marble or Indiana limestone.

22. The disposable tool of claim 1, wherein a surface of the natural rock material is treated with a sealer.

23. The disposable tool of claim 22, wherein the sealer comprises a slurry comprising nanoparticles.

24. The disposable tool of claim 1, wherein the valve structure comprises a sleeve disposed within the bore.

25. The disposable tool of claim 1, wherein the sleeve comprises a slidable sleeve.

26. The disposable tool of claim 25 further comprising a return member, the return member comprising a third natural rock material.

27. The disposable tool of claim 26, wherein the third natural rock material comprises limestone.

28. A disposable downhole tool, comprising:

a disposable plug that is sealable against a disposable plug seat of a disposable valve structure and configured for sealing a bore, the disposable plug having a sealing surface, the sealing surface formed as a single rock piece of a natural rock material.

29. The disposable tool of claim 28, wherein the natural rock material comprises a sedimentary rock.

30. The disposable tool of claim 29, wherein the sedimentary rock comprises limestone.

* * * * *